United States Patent [19]

Maoz

[11] Patent Number: 5,068,670

[45] Date of Patent: Nov. 26, 1991

[54] BROADBAND MICROWAVE SLOT ANTENNAS, AND ANTENNA ARRAYS INCLUDING SAME

[76] Inventor: Joseph Maoz, 23 Emek Habracha, Tel Aviv 67456, Israel

[21] Appl. No.: 470,203

[22] Filed: Jan. 25, 1990

Related U.S. Application Data

[63] Continuation-in-part of Ser. No. 186,261, Apr. 26, 1988, abandoned.

[30] Foreign Application Priority Data

Apr. 16, 1987 [IL] Israel ..... 82331

[51] Int. Cl.[5] ..... H01Q 13/10

[52] U.S. Cl. ..... 343/767; 343/770; 343/862; 343/864

[58] Field of Search ... 343/767, 770, 771, 700 MS File, 343/850, 860, 862, 863, 864

[56] References Cited

FOREIGN PATENT DOCUMENTS 44241 3/1980 Japan ..... 343/770

128903 10/1980 Japan ..... 343/770

*Primary Examiner*—Michael C. Wimer

*Attorney, Agent, or Firm*—Benjamin J. Barish

[57] ABSTRACT

A broadband microwave antenna exhibiting high radiation efficiency over a broad frequency band in which the VSWR is less than 2.5:1 over at least 15% of the frequency band, includes a ground plane at one side of a dielectric substrate and formed with at least one slot, and a feed strip at the other side of the substrate. The feed strip is of uniform width for substantially its complete length, but includes a change in width at the feed end of the slot to produce a first impedance matching network effective to bring the slot impedance to the level of the feed line over the broad frequency band, and another change in width at the load end of the slot to produce a second impedance matching network which reduces the slot reactance to match the reactive impedance of the load to the reactive part of the slot impedance over the broad frequency band.

17 Claims, 8 Drawing Sheets

FIG 8a
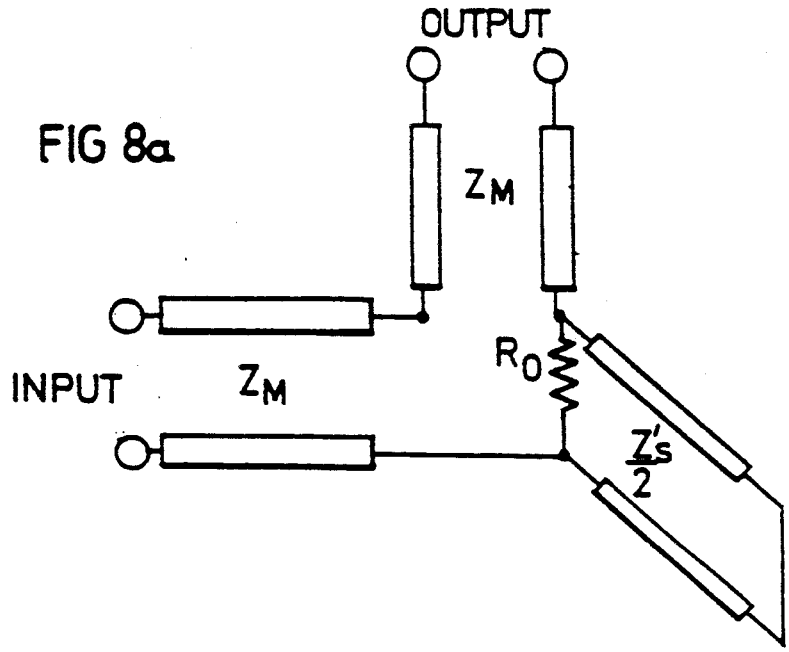
FIG 8b
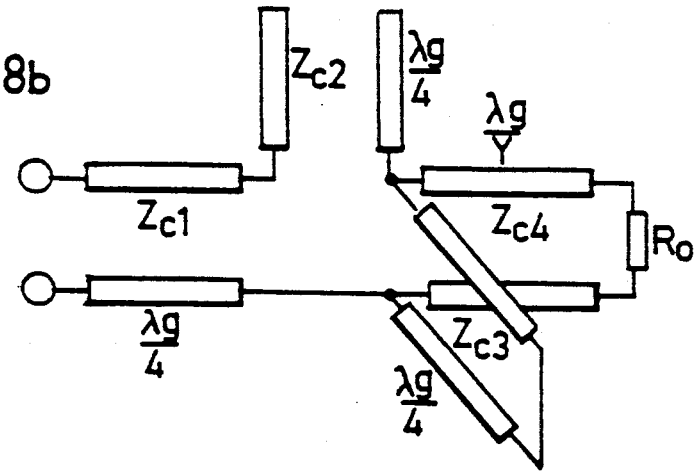
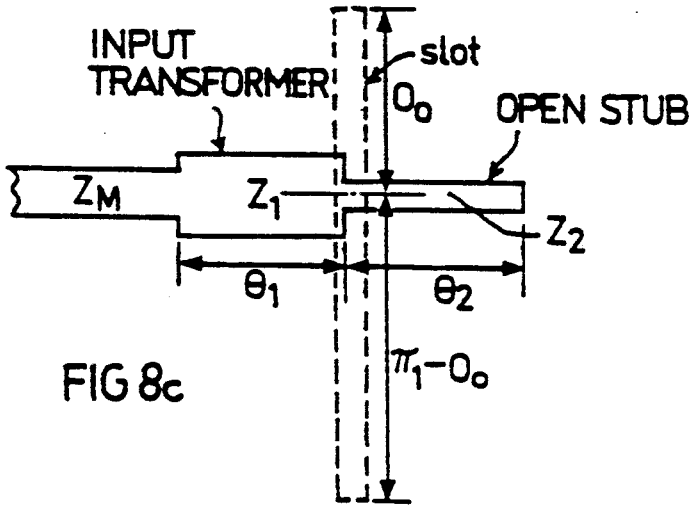
FIG 8c

BROADBAND MICROWAVE SLOT ANTENNAS, AND ANTENNA ARRAYS INCLUDING SAME

RELATED APPLICATION

The present application is for a continuation-in-part of patent application Ser. No. 07/186,261, filed Apr. 26, 1988, now abandoned.

FIELD OF THE INVENTION

The present invention relates to broadband microwave slot antennas, and also to antenna arrays including such antennas. The invention is applicable to slot antennas including one ground plane, commonly called microstrip slot radiators, and also to antennas including two ground planes, commonly called stripline slot radiators.

BACKGROUND OF THE INVENTION

Microwave slot antennas have been used as standalone antennas and as elements of antenna arrays. They generally comprise a metal ground plane, a dielectric board, a metal feed line and a metal cover, the radiating slot being cut or etched in the ground plane at an angle of 0° to 90° to the line. Such slots present series impedance to the feed line.

In the prior art, the slot antenna has been considered narrow band in nature. In view of this assumed property, slot antenna designs have been aimed at achieving good impedance match over a narrow frequency band, of 10% (for wide slots) or less. This match is commonly realized by cancelling the reactive portion of the impedance by a quarter wavelength open circuit stub at the load end of the radiator, extending beyond the slot. Impedance match at a single frequency was achieved by dislocation of the feed point from the center of the slot (offset-fed slot). Thus matched, highly efficient operation of the slot radiator was achieved, however, only within a narrow frequency band. Existing matching networks have been narrow band by nature. Impedance transformers along the feeding line at the generator side, if present, have been a part of a power dividing network, rather than the antenna element itself. An example of a power dividing network is the Wilkinson type, wherein a 50- ohm line is divided into two 100-ohms lines followed by impedance transformers for transforming the impedance back to the 50-ohm level.

OBJECTS AND BRIEF SUMMARY OF THE INVENTION

An object of the present invention is to provide a microwave slot antenna displaying high radiation efficiency over a broad frequency band, i.e., in which the VSWR (voltage standing wave ratio) is less than 2.5:1 over at least 15% of the frequency band around the resonant frequency. Another object of the invention is to provide an antenna array including a plurality of such microwave slot antennas.

The invention is based on the observation by the inventor that the slot radiator is actually a wide band element. The traditional restrictions on the bandwidth stem from the high slot impedance, which is typically of the order of 600 ohms when fed at the center. A detailed mathematical analysis, set forth below, shows that had a compatible line of 300–400 ohms been used for feeding, a VSWR of 2.5 or less would be observed over more than 25% of the frequency band. Alternatively, the impedance level can be transformed to the order of the feed line, thereby achieving a similarly wide bandwidth. This bandwidth allows for a design of a wide band matching network in order to fully utilize this property, which has not been obvious in the prior art where the inherent wide bandwidth had not been appreciated.

In the present invention, the microwave fed slot antenna is matched to the feeding line by a dual matching network, allowing for a wide bandwidth not attained in the prior art. This new arrangement comprises two parts. One part is at the feed end of the slot, whereat the feed strip is changed in width to produce a first impedance matching network at the feed end of the slot effective to bring the slot impedance to the level of the feed line over a broad frequency band, in which the VSWR is less than 2.5:1 over at least 15% of the frequency band. The other part is at the load end of the slot, whereat a second impedance matching network is provided to reduce the slot reactance to the order of zero over the above wide frequency band. The second impedance matching network may be a distributed reactive load, namely a change in the width of the feed strip as the impedance matching network at the feed end of the slot; alternatively, it may be the combination of a distributed reactive load, and a lumped reactive load. Such a construction produces a radiator which displays high radiation efficiency over a broad frequency band in which the VSWR is less than 2.5:1 over at least 15% of the frequency band.

According to the present invention, therefore, there is provided a broadband microwave antenna exhibiting high radiation efficiency over a broad frequency band in which the VSWR is less than 2.5:1 over at least 15% of the frequency band, comprising: a dielectric substrate; an electrically conductive layer serving as a ground plane on at least one side of the dielectric substrate; a feed line in the form of a feed strip of electrically conductive material at the other side of the dielectric substrate. The ground plane is formed with a slot having a feed end at one side of the slot, and a load end at the opposite side of the slot, said feed end being electromagnetically coupled to the feed strip for feeding thereto the energy to be radiated or received. The feed strip is of uniform width for substantially its complete length, but includes at least one change in width at the feed end of the slot to produce a first impedance matching network at the feed end of the slot effective to bring the slot impedance to the level of the feed line over the broad frequency band. The feed strip includes a second change in width at the load end of the slot reducing the slot reactance to match the reactive impedance of the load to the reactive part of the slot impedance over the broad frequency band.

The invention is to be sharply distinguished from prior known constructions of microwave slot radiators and antennas.

Thus, Engleman U.S. Pat. No. 2,654,842 has a load end matching stub; however, no broad band matching is offered. Moreover, Engleman provides no matching structure at the generator side of any of the elements, apart from the transformer inherent to the power splitter used at the input of the array. The load end is a narrow band matching capacitor. Furthermore, the system is made of wires and not of microstrip or stripline.

In Ushigome Japanese Patent 44,241, the "load end" 7 is not at the far end of the slot, and does not participate in the matching mechanism. It is used for setting the phase and amplitude differences between the antenna elements. It is an entirely different mechanism with narrow bandwidth and different applications.

Nakahara West German Patent 2,104,241 shows slots at an angle to a stripline structure; however, no attempt is made to broadband match the slot.

Toritsuka Japanese Patent 12,104 shows slot arrays with a power dividing network including impedance transformers designed to match the power splitters to the microwave line, again with no attempt to provide broadband matching.

Sugita Japanese Patent 47,104 has narrow band slots with filter networks 31, 33 used in conjunction with an integrated oscillator; however, no broadband matching is offered.

Rosenthal Netherlands Patent 7,702,597 suggests narrow band slot arrays, again with transformers used for matching of the power splitters.

Itou Japanese Patent 147,048 shows a narrow band impedance matching network used for serial feeding of a slot array, as a part of the power dividing mechanism.

Sugita Japanese Patent 128,903 describes a dual polarized narrow bandwidth slot fed with a power splitter which again includes the inherent impedance match.

Kamata Japanese Patent 141,807 shows a narrow band impedance match included in the power splitter and providing a 2.5:1 VSWR bandwidth of 4% only.

In summary, the frequency band in which the above prior art microwave slot antennas exhibit a VSWR of less than 2.5:1, and high radiation efficiency, is usually limited to 5 to 7 percent of the resonant frequency. Such prior art constructions are to be distinguished from the invention of the present application which exhibits high radiation efficiency over a broad frequency band, namely in which the VSWR is less than 2.5:1 over at least 15%, and usually over at least 25%, of the resonant frequency.

The slot cut in the ground plane of the microwave structure represents a radiating element, which is excited by the electromagnetic coupling to the microwave feed line. The slot may be asymmetrically positioned relative to the feed line strip. The slot may be transversal, i.e., cut at an angle of 90° to the strip, or may be aligned at a suitable angle thereto. Instead of one slot, twin slots may be provided as radiators, as well as one slot excited by a number of microwave lines.

The radiator operates in a broad frequency range about the resonant frequency. The low VSWR operation over the broad frequency band is achieved by proper choice of resistance presented by the radiating slot to the microwave feed line at its resonance frequency, and by proper design of the broadband dual matching network.

The broadband dual matching network may be realized in a number of ways, using distributed or lumped reactive elements, or the combination thereof. Preferably, the generator side of the broadband dual matching network may be affected by changing the width of the feed strip for a selected length to produce an impedance transformer consisting of one or several sections preferably of non-quarter wavelength transmission lines, with each section having its properly chosen characteristic impedance. The load side of the broadband dual matching network may be an open-circuited stub of length equal to $n \cdot \lambda_g/4$, where n is an odd number, or a short-circuited stub of length equals to $m \cdot \lambda_g/4$, where m is an even number, or any other reactive circuit with a desired frequency response.

By way of example only, the load side of the broadband dual matching network may be a resonant circuit of inductor and/or capacitor serially connected. The resonance frequency of this circuit should be close to the slot resonance frequency.

It is well-known that a slot cut in the ground plane of the microwave radiator feed line radiates in both directions. In cases where radiation into the dielectric board side is undesirable, a metallic cover should be provided at this side at some distance away from the board and the feeding microwave radiator.

The invention also provides an antenna array including a plurality of microwave radiators as described above, and power division circuitry, phase control circuitry and/or amplitude control circuitry, for feeding the radiators from the feed line.

Further features and advantages of the invention will be apparent from the description below.

BRIEF DESCRIPTION OF THE DRAWINGS

The invention is herein described, by way of example only, with reference to the accompanying drawings, wherein:

FIGS. 1–4, 5*a*, 5*b*, 6, 7*a*, 7*b*, 8*a*, 8*b*, 8*c*, 9–12 are diagrams helpful in understanding the Mathematical Analysis set forth below leading up to the present invention;

MATHEMATICAL ANALYSIS

Before describing the preferred embodiments of the invention illustrated in FIGS. 13–19, the following mathematical analysis, which refers to FIGS. 1–12, will be helpful in fully understanding and appreciating the invention.

A Model of the Offset-Fed Radiating Slot

Figure 1:
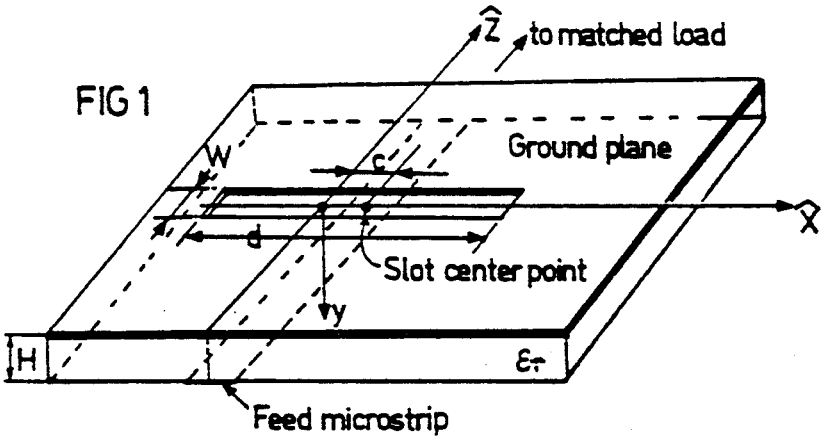
Figure 2:
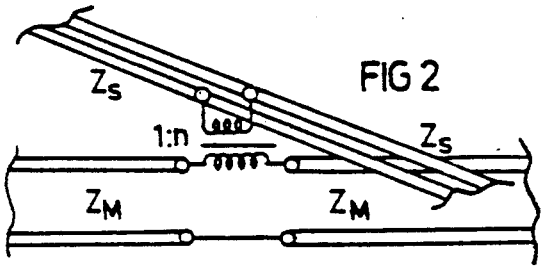
Figure 3:
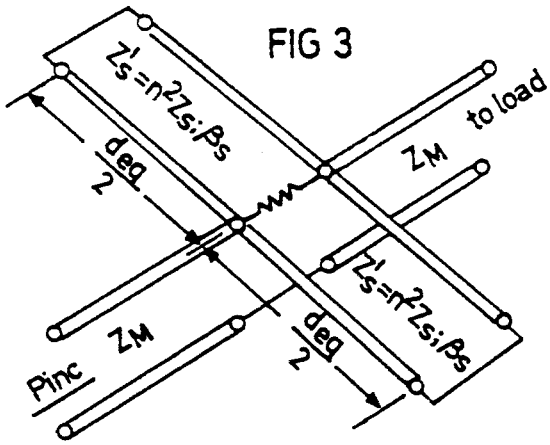
Figure 4:
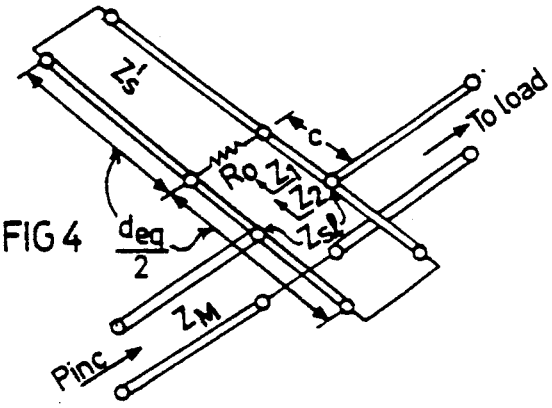

FIG. 1 schematically illustrates the geometry of the offset-fed slot in the ground plane of a microwave slot radiator; FIG. 2 illustrates the model of a microwave-slot line junction; FIG. 3 illustrates the model of a center-fed slot; and FIG. 4 illustrates the model of an offset-fed slot.

The model illustrated in FIG. 2 was given by J. Knorr (IEEE Transactions on Microwave Theory and Technique, Vol. MTT-22 (May 1974), pp 548–554). In this model the impedance of the slot-line is connected in series to the microstrip through a transformer. Zm and Zs are the characteristic impedance of the microstrip and slot-line respectively. The effect of the radiation losses in a center-fed slot can be accounted for by active resistor $R_{rad}$ connected at the slot center point. The model of the center-fed radiating slot, after elimination of the transformer and the corresponding impedance transformation, is given in FIG. 3. The length $d_{eq}$ of the transmission line equivalent to the slot is somewhat greater than the slot's physical length: $d_{eq}=d+2\Delta$. This is due to a well-known inductive end-effect of the short-circuited slot-line. In cases, when the value of the inductance (L) cannot be evaluated using one of known methods, $d_{eq}$ can be calculated from the formula:

$$d_{eq} = \frac{150}{\sqrt{E_r^{eff}}\, f^{RES}[\mathrm{GHz}]} \tag{1}$$

Data on effective dielectric constant $E_r^{eff}$ and characteristic impedance $Z_s$ of the dielectric-backed slot-line is available for high or low-permittivity substrates, respectively. Slot resonance frequency $f^{RES}$ for the center-fed slot can be easily measured or determined theoretically by one of several available methods.

The model of the offset-fed slot given in FIG. 4 is the logical generalization of the model in FIG. 3. Resistor Ro across the equivalent of the slotline has the same value as in the case of a center-fed slot. This model illustrates that lower levels of impedances viewed by the microstrip at the feed point are achieved by tapping closer to the short circuited end of the slot-line. Using this model, closed-form expressions for the complex slot radiation impedance and corresponding S-parameters can be readily written:

$$Z_{s1} = j\frac{Z_2 Z'_s \tan[\beta_s(d_{eq}/2 - C)]}{Z_2 + jZ'_s \tan[\beta_s(d_{eq}/2 - C)]} \tag{2a}$$

$$Z_2 = Z'_s \frac{Z_1 + jZ'_s \tan(\beta_s C)}{Z_s^{1-} + jZ_1 \tan(\beta_s C)} \tag{2b}$$

$$Z_i = j\frac{R_O Z'_s \tan(\beta_s d_{eq}/2)}{R_O + jZ'_s \tan(\beta_o d_{eq}/2)} \tag{2c}$$

$$Z'_s = Zs \cdot n^2 \tag{2d}$$

$$S_{11} = \frac{Z_{s1}}{Z_{s1} + 2} \tag{3a}$$

$$S_{12} = \frac{2}{Z_{s1} + 2} \tag{3b}$$

Experimental Verification of the Model

Experimental verification of the above-described model was undertaken for the practically important case of the slot radiator printed on the low-permittivity substrate.

A slot of length d=60 mm and width w=2 mm was etched in copper-claded Duroid 5880 with thickness 62 mil and fed by 50 ohms microstrip line. The far end of the microstrip was matched loaded.

At the initial stage the resonance frequency of 2.2 GHz and transmission at resonance $|S_{12}|_{RES}=-17.2$ dB=1.138 were measured for a center-fed slot. Transformed radiation resistance Ro was then calculated from relationship applicable at resonance:

$$Ro = \frac{2}{|S_{12}|_{RES}} - 2 = 12.49 \tag{4}$$

Closed-form expressions from [13] for $E_r^{EFF}$ and Zs yield values 1.2323 and 126.5 ohms respectively. The transformation factor n was computed using known formulas and equals 0.9686. From Equation (1), it follows that $d_{eq}=61.42$ mm.

Figure 5A:
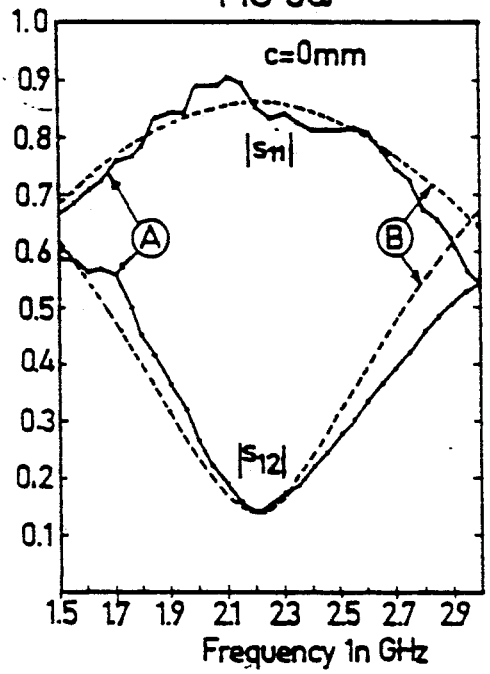
Figure 5B:
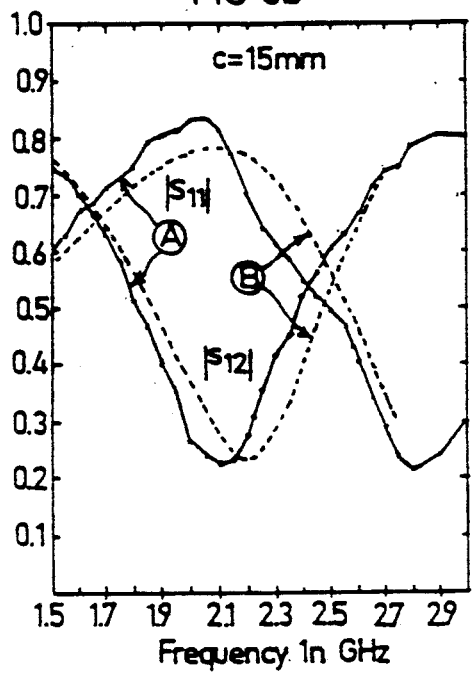

Absolute values of reflection and transmission coefficients were plotted in FIG. 5 versus frequency besides experimental curves. An agreement between S-parameters derived from proposed model and measured data is satisfactory for most practical needs both for center-fed (FIG. 5*a*) and offset-fed (FIG. 5*b*) cases. The fact that the maximum value of the reflection coefficient $|S_{11}|_{max}$ and the minimum value of transmission coefficient $|S_{12}|_{min}$ occur at somewhat different frequencies is also predicted by the model.

Figure 6:
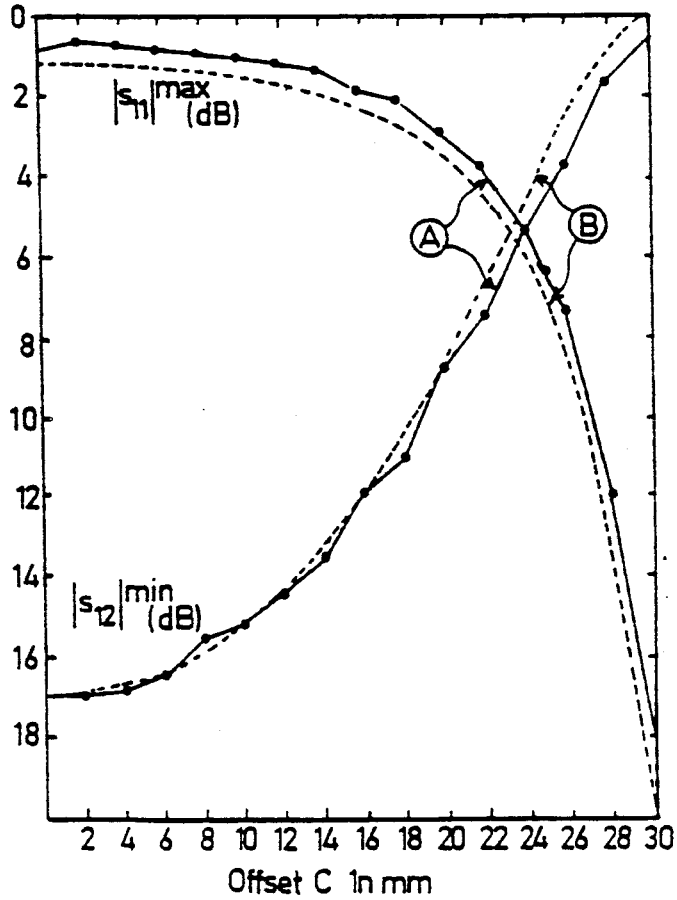
Figure 7A:
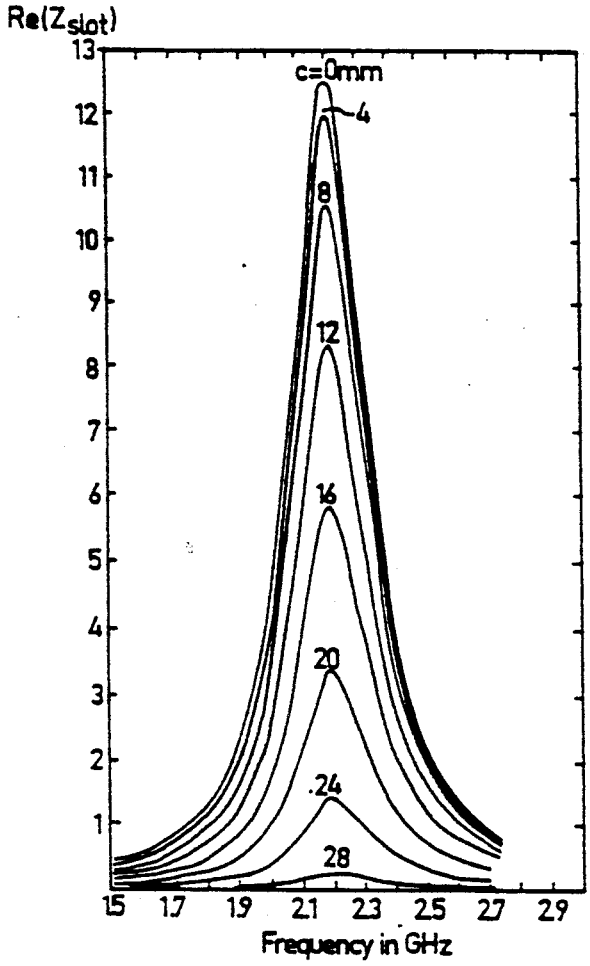
Figure 7B:
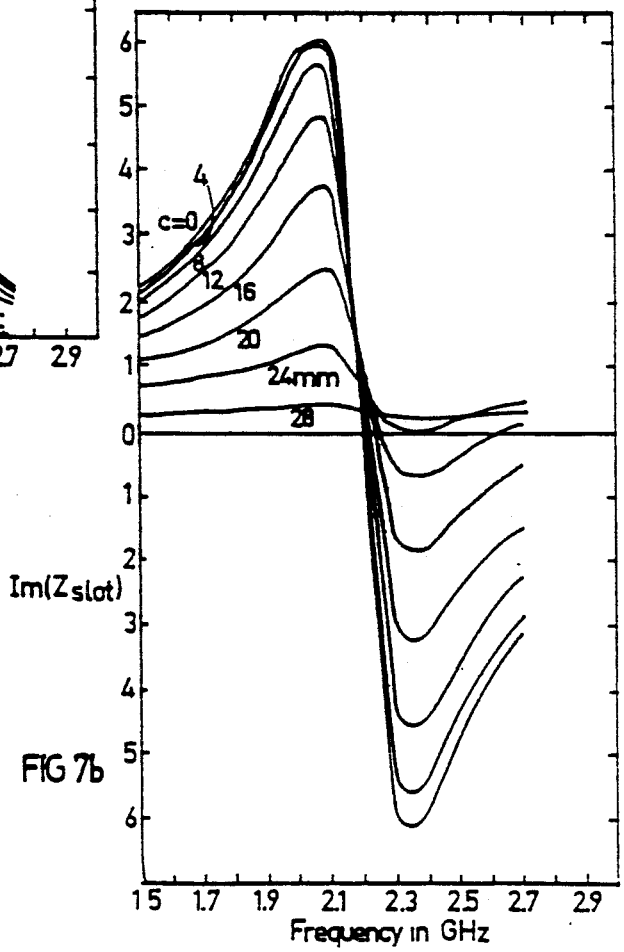

FIG. 6 demonstrates the effect of the slot offset on $|S_{11}|_{max}$ and $|S_{12}|_{max}$. An agreement between data derived from the above formulas and experiments is quite good. The impedance of a center-fed slot behaves like a conventional parallel resonance circuit; at resonance, Re(Zsl) reaches its maximum value Ro, and the curve of slot reactance Im(Zsl) is nearly antisymmetric around $f^{RES}$. Zsl is inductive below and capacitative above resonance frequency. As the offset C grows, the curve of slot reactance becomes asymmetric and more inductive. For large offsets the slot reactance does not cross zero and is inductive in the operational frequency range; that makes the concept of "resonance" unapplicable. The above is demonstrated in FIG. 7 (FIG. 7*a* and 7*b*), in which the slot impedance was computed for a wide range of offset values.

Broadband Slot Radiators Per the Present Invention

The above transmission line model of the slot radiator shows the way in which its broadband performance can be achieved. FIG. 8*a* is merely a redrawn equivalent circuit of a center-fed slot radiator, as given in FIG. 3. FIG. 8*b* presents an equivalent circuit of the fourth-order Marchand balun known for its broad bandwidth. In the original fourth-order, Marchand balun for the electrical length of all transmission lines equals 90°, and the characteristic impedances $Z_{c1}$, $Z_{c2}$ and $Z_{c3}$ are optimized for the best input impedance matching. Both circuits can be done identical if in FIG. 8*a* an input $\lambda_g/4$ transformer and output $\lambda_g/4$ —long stub are introduced, and the following restrictions are imposed on the elements in FIG. 8*b*:

$$Z_{c3}=Z'_s/2 \tag{5a}$$

$$Z_{c4}=Ro \tag{5B}$$

The microstrip embodiment of the resultant feed circuit is shown in FIG. 8*c* for the more general case of the offset-fed slot. Here, electrical lengths $\theta_0$, $\theta_1$, $\theta_2$, as well as characteristic impedances $Z_{c1}$ and $Z_{c2}$, are subject to optimization. Optimization capability of most microwave software packages (such as Super-Compact (TM) or Touchstone (TM)) are sufficient to perform the job.

This design procedure was applied for various desired bandwidths in the 16%–26% range, and resultant parameters of the feed network are set forth in Table 1 below. The computed return loss of the radiator is depicted in FIG. 9 versus normalized frequency for each of these parameter set.

TABLE 1

Parameters of the Microstrip Feed Network for Bidirectional Slot Radiator Printed on an Infinite Dielectric Board (62 mil Thick RT-Duroid 5880).

Figure 9:
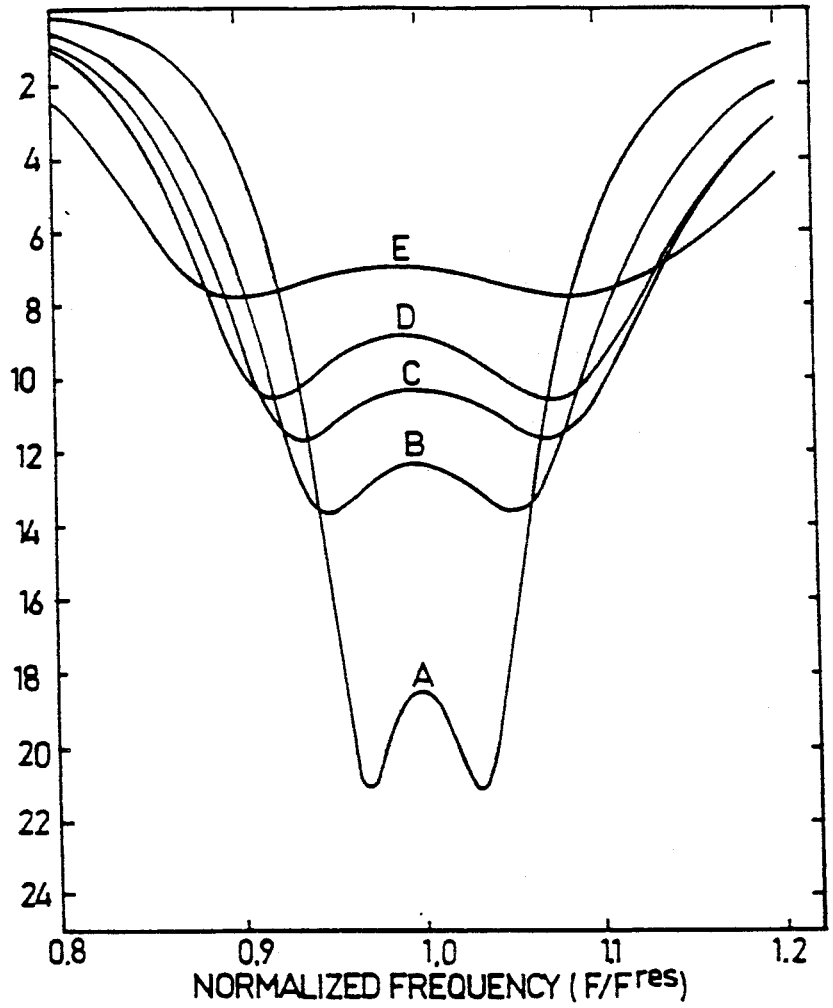

| Bandwidth in percents (VSWR less than 2.5:1) | $\theta_o$ (deg) | $Z_{ci}$ (ohms) | $\theta_1$ (deg) | $Z_{c2}$ (ohms) | $\theta_2$ (deg) | Curve in FIG. 9 |
|---|---|---|---|---|---|---|
| 16.4 | 9.45 | 23.2 | 119.1 | 57.8 | 63.8 | A |
| 20.8 | 12.8 | 28.5 | 115.2 | 52.0 | 57.5 | B |
| 23.8 | 14.7 | 30.3 | 118.3 | 50.5 | 53.7 | C |
| 24.8 | 16.0 | 30.6 | 120.0 | 46.7 | 50.0 | D |
| 26.4 (*) | 21.4 | 36.5 | 124.8 | 44.2 | 43.7 | E |

(*) VSWR less than 2.7:1

Figure 10:
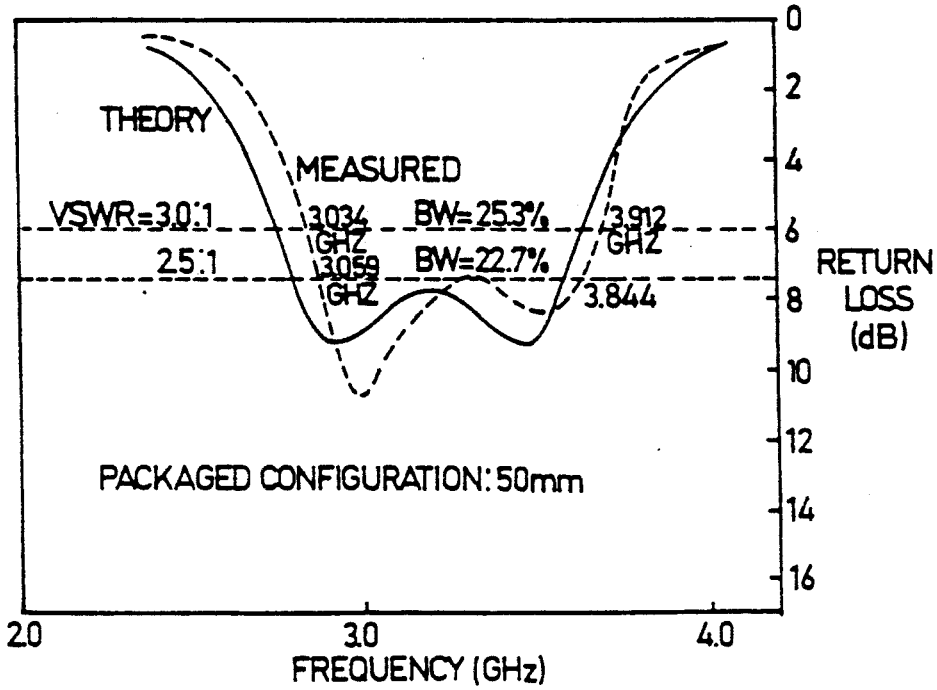
Figure 11:
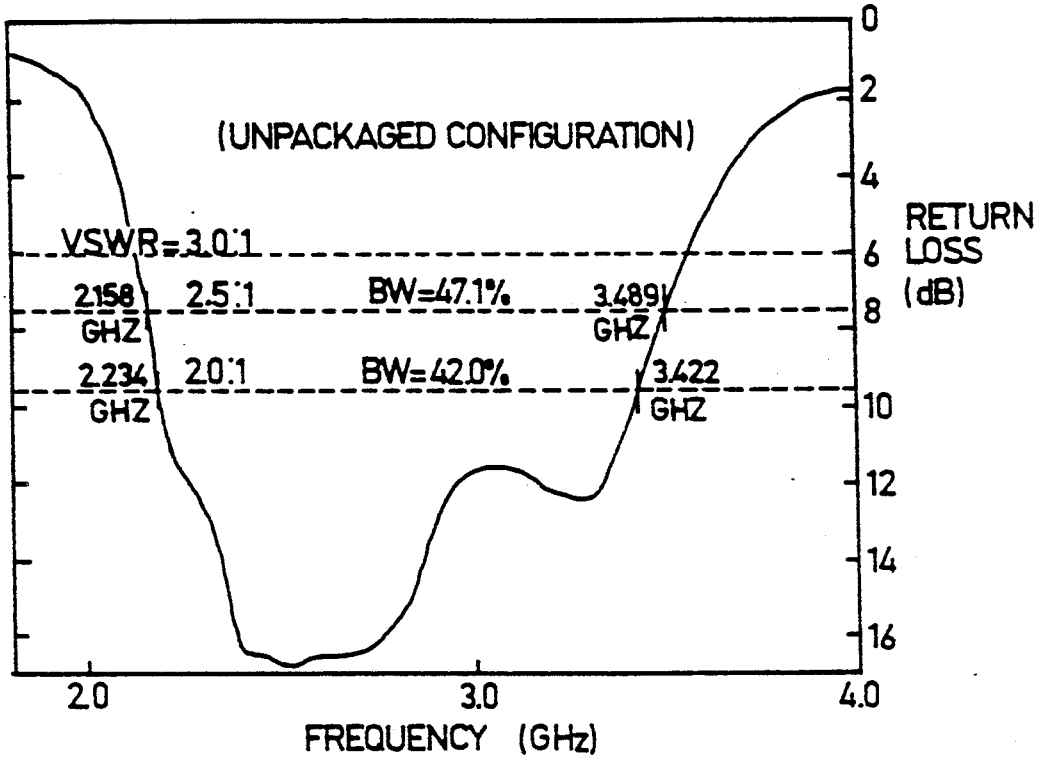

FIG. 10 shows the return loss of the 40 mm-long slot radiator with bi-directional radiation performed on finite (50 mm×50 mm) Duroid 5880, 62 mil thick board. Observed bandwidth is 47%; that is much more than predicted by the model. This discrepancy is mainly due to small ground plane dimensions.

The design of unidirectional (packaged) slot radiators may be facilitated by using the following semi-experimental procedure:

(a) pick the offset value ($\theta_0$) from Table 1 versus desired bandwidth value;

(b) measure the transmission loss ($S_{12}$) of the transverse cavity-backed slot offset-fed by the uniform 50 ohm microstrip line;

(c) calculate Ro by substitution of the measured transmission loss $|S_{12}|_{RES}$ into Equation (4);

(d) pick such a value of Zs in a model in FIG. 4 that the model $S_{12}$ frequency response matches optimally the measured data;

(e) synthesize the feed network as it was described for unpackaged slot configuration.

This procedure was tried for a 40 mm-long slot printed on 62 mil-thick Duroid 5880 and backed by a cavity with dimensions 50 mm×50 mm×10 mm. The resultant theoretical and measured frequency responses are brought in FIG. 10 and are in good agreement. The bandwidth of the developed radiator is about 24%.

Radiation patterns of the above radiators are identical to the patterns of a half-wave magnetic dipole and are not given here.

DESCRIPTION OF PREFERRED EMBODIMENTS

General Construction

Figure 12:
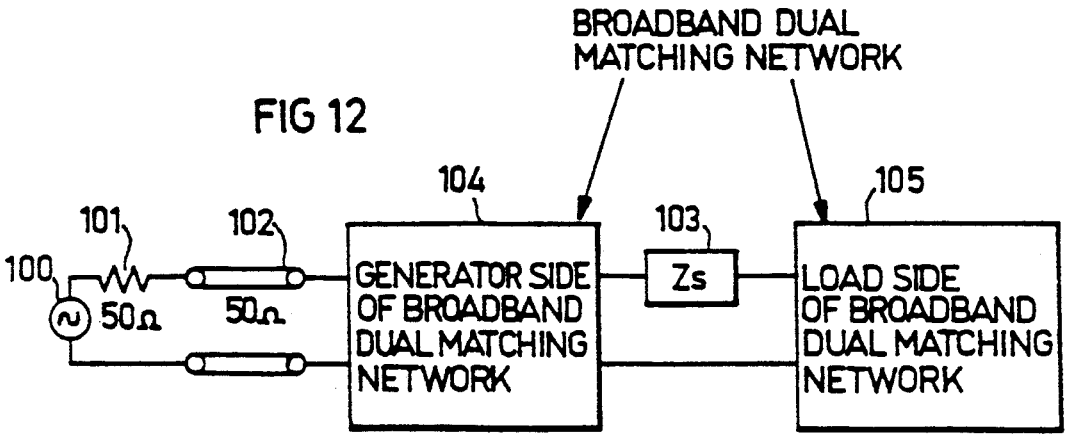

FIG. 12 is a block diagram of a microwave slot radiator according to the invention. The radiator is fed from the generator 100 having an internal impedance 101, which preferably equals 50 ohms. The generator is connected to the radiator by the transmission line 102, having a characteristic impedance matched to the internal impedance of the generator, i.e., 50 ohms. The slot (not shown), which is cut in the ground plane of the feed line, exhibits equivalent series impedance 103, which is designated $Z_s$. Impedance $Z_s$ obtains frequency dependent complex values and is usually presented in the form:

$$Z_s = R_s(f) + jX_s(f) \tag{6}$$

The radiating slot resonance frequence $f_o$ is the frequency at which $X_s$ equals zero:

$$X_s(fo) = 0 \tag{7}$$

In most cases the frequency response of $Z_s$ is similar to that of a parallel resonant circuit, and at frequencies around resonance can be characterized by a resonant resistance:

$$R_s^{RES} = R_s(f_o) \tag{8}$$

and the derivative:

$$\left.\frac{\partial X_s}{\partial f}\right|_{f=fo}$$

The feed circuit comprises two main parts: the generator side of the broadband dual matching network 104, and the load side of the broadband dual matching network 105. The broadband matching network is termed "dual" because of the two branches 104 and 105.

The low VSWR broadband operation VSWR of less than 2.5:1 over a frequency range of at least 15% of the frequency band is achieved by the proper choice of impedance presented by the radiating slot to the microstrip feed line at resonance frequency, $R_s^{RES}$, and by proper design of the broadband dual matching network.

Figure 13:
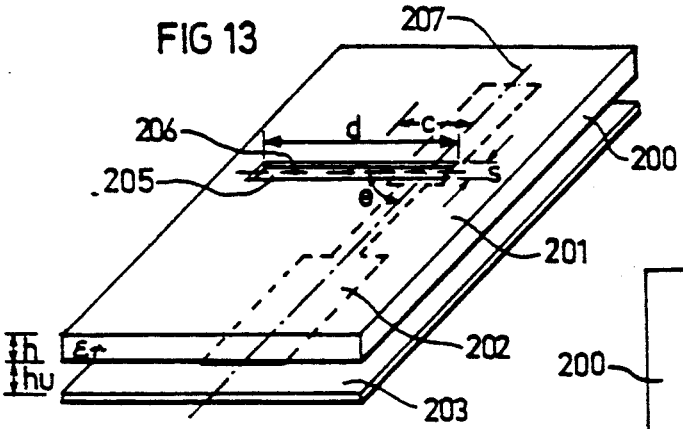
FIG. 13 is a perspective view illustrating one form of microwave radiator having a single slot constructed in accordance with the present invention.
Figure 14:
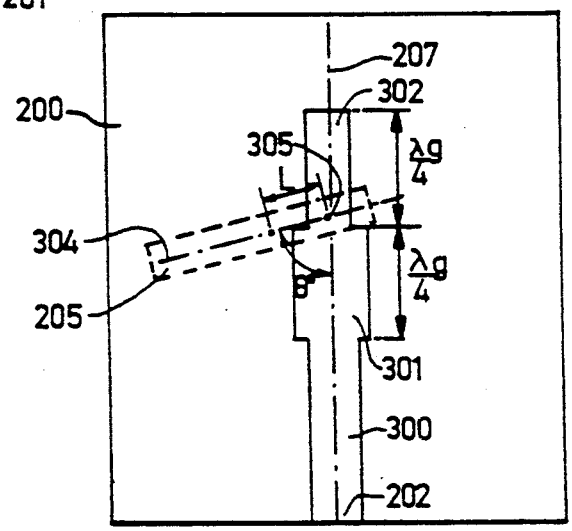
FIG. 14 is a schematic plan view illustrating another form of radiator corresponding to that of FIG. 13.

Construction of FIGS. 13 and 14

FIGS. 13 and 14 are perspective and plan views, respectively, illustrating one example of a microwave slot radiator constructed in accordance with the invention having a single slot 205. The radiator comprises a dielectric board or substrate 200, a metal ground plane 201, a feed line in the form of a conductive strip 202, and a metal cover 203 located a short distance from the feed line strip 202. The radiating slot 205 is cut or photochemically etched in the ground plane 201. The shape of slot 205 is rectangular, although it may be of any other suitable shape.

Typically, the length d (FIG. 13) of slot 205 is about one-half the wavelength of the relevant slot-line at the center point of the intended antenna operating frequency band. The slot width S can be in the range of 0.001 to 0.3 of the free space wavelength. The slot is preferably asymmetrically positioned relative to the feed line strip 202, with C (FIG. 13) designating the distance of the slot center point on center line 206 from the center line 207 of the feed line strip 202.

The slot 205 may be cut at 90° to the strip, or at any suitable angle $\theta°$ thereto. $R_s^{RES}$ depends on C and $\theta°$; thus both C and $\theta'$ can be used to tune the $R_{sRES}$ to values suitable for impedance matching over the broadest operational frequency band. Common impedance matching practice shows that $R_s^{RES}$ should be preferably in the range of $0.1Z_0 - 10Z_0$, where $Z_0$ is the characteristic impedance of the transmission line 102 connecting the generator 100 to the radiator (e.g., 50 ohms).

As shown particularly in the plan view of FIG. 14, the feed microstrip circuit comprises the transmission line 300 connecting the radiator to the generator, the generator side of the broadband dual matching network 301, and the load side of the matching network 302. The line 300 is preferably a 50-ohm microstrip line, in the form of an electrically-conductive strip of uniform width for substantially its complete length. However, at the generator side, the line 300 is widened, as shown at 301, to produce a broadband dual matching network in the form of a quarter-wavelength transformer. At the load side, the line 300 is narrowed, as shown at 302, to produce a broadband dual matching network which takes the form of an open circuited quarter-wavelength microstrip stub. The center line of the feed microstrip line 207 intersects the axis of the slot 304 at the feed point 305.

The characteristic impedances of the impedance matching networks defined by transformer 301 and the open stub 302 are optimized to obtain minimum VSWR in the prescribed frequency range around the slot resonance frequency, and the widths of all three microstrip line sections 300, 301 and 302 can be determined from their characteristic impedances both in accordance with known microstrip design practices.

One operating embodiment of the radiator shown in FIGS. 13 and 14 has been constructed with a center operating frequency of 3.1 GHz. For this particular model, the slot 205 was of rectangular form, approximately 40 mm long and 1 mm wide. The slot 205 and the feed line sections 300, 301 and 302 were formed by photochemically etching the copper clad surfaces of dielectric board 200 made of Teflon (TM) fiberglass, having a relative permittivity ($\epsilon_r$) of 2.2. The thickness of the dielectric board 200 was approximately 0.062 inches (1.58 mm). The radiating slot 205 was etched transversely to the feed microstrip, i.e., $\theta=90°$ ; and shift C was approximately 16 mm. The metal cover 203 was placed at approximately 15 mm from the microstrip feed structure. It was found that a radiator so built exhibited a VSWR of less than 2.5:1 over a 30 percent wide frequency band.

Figure 15:
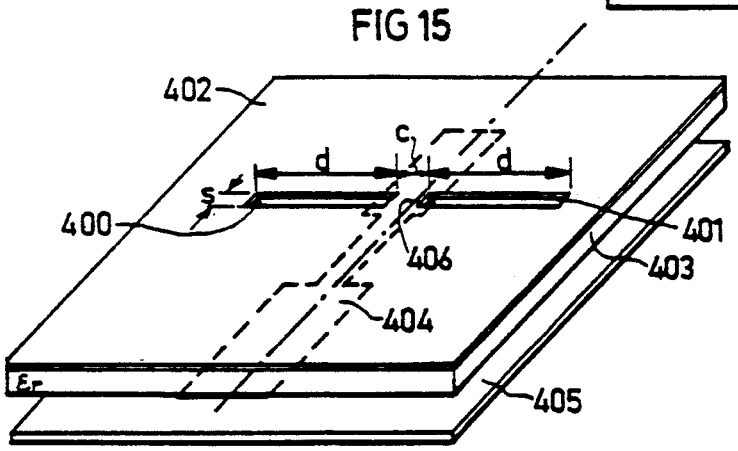
FIG. 15 is a perspective view illustrating a twin-slot microwave radiator constructed in accordance with the invention.

FIG. 15 schematically illustrates a microstrip twin-slot radiator. Two identical transverse slots 400 and 401 are cut or etched in the ground plane 402 clad on dielectric substrate 403. The slots 400 and 401 are fed by the microstrip feed line 404. A metallic cover 405 can be provided in cases where slot radiation from two sides is undesirable. In this example, the feed structure was otherwise constructed in a manner similar to that shown in FIGS. 13 and 14. This feed line structure is typically formed by photochemically etching copper-clad surfaces of the dielectric substrate, as described above with respect to FIGS. 13 and 14.

In a twin-slot radiator of the kind shown in FIG. 15, the width of the bridge 406 between the slots provides the proper value of equivalent slot radiation resistance at resonance, $R_s^{RES}$.

Figure 16:
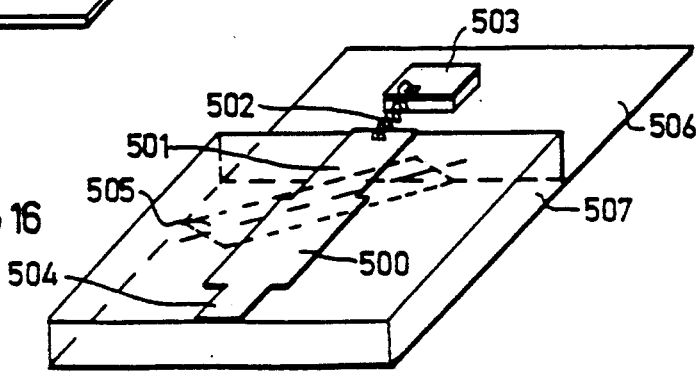
FIG. 16 is a perspective view of a microwave slot radiator constructed in accordance with the present invention to include a lumped reactive load at the load end of the slot.
Figure 17:
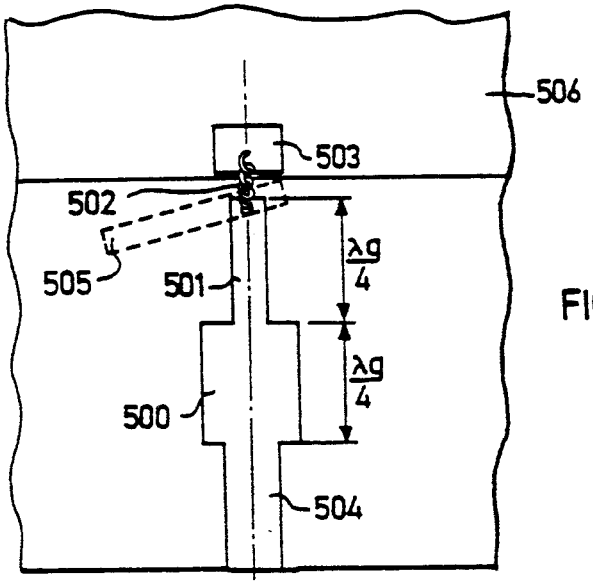
FIG. 17 is a schematic plan view of the microwave radiator of FIG. 16.

The embodiment of the invention schematically illustrated in FIGS. 16 and 17 is a single microstrip slot radiator with the feed line at the generator side of the slot widened and narrowed, as shown at 500 and 501, respectively, to define a broadband dual matching network in the form of two quarter-wavelength long microstrip line sections. Here, the load side of the broadband dual matching network includes lumped circuit element, namely inductor 502 and capacitor 503 connected in series. The feed line sections 500, 501 are connected to the generator (not shown) by a microstrip transmission line 504, with a characteristic impedance of 50 ohms. The radiating slot 505 is etched in the ground plane 506. In this embodiment, the radiating slot 505 is made in the same manner as described above with respect to FIGS. 13 and 14. The choice of the slot shift from the center line of the feed line sections 500, 501, and the choice of angle $\theta$, should ensure proper value of $R_s^{RES}$, as described more particularly above with respect to FIGS. 13 and 14.

Microstrip sections 500, 501 and 504, as well as radiating slot 505, are all formed by photochemically etching copper clad surfaces of dielectric substrate 507, as known in the art.

Because of its use at high-frequencies, the capacitor 503 should preferably be one using thin-film single layer parallel-plate capacitor technology. The capacitor 503 is soldered or attached to the ground plane 506 in a manner shown in FIGS. 16 and 17, by using conductive epoxy glue, or via plated-through holes in the dielectric substrate 507. Inductor 502 is soldered between the microstrip section 501 and capacitor 503.

Capacitor 503 and inductor 502 comprise a series resonance circuit, with resonance frequency close to $f_o$, the slot resonance frequency. The reactance $X^{RES}$ of inductor and capacitor at resonance frequency:

$$X^{RES} = 2\pi f_o L = \frac{1}{2\pi f_o C}, \tag{9}$$

as well as the characteristic impedances of the microstrip section 500 and 501, should be optimized to ensure the low VSWR and, consequently, highly efficient operation, in the prescribed frequency band around the slot resonant frequency.

Figure 18:
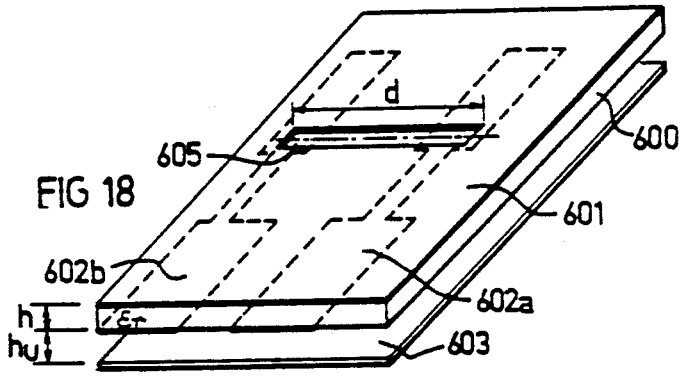
FIG. 18 is a perspective view of a microwave slot reader similar to that illustrated in FIGS. 13 and 14 but including two feed lines intercepting a single slot.

FIG. 18 illustrates a broadband slot radiator, similar to that of FIGS. 13 and 14, but including a plurality of feed lines 602A, 602B electromagnetically coupled to the radiating slot 605 cut in the ground plane 601. In this case, each of the feed lines 602A, 602B is changed in thickness at the feed end of the slot to provide an impedance matching network effective to bring the slot impedance to the level of the feed line over the above-mentioned broad frequency band, and are also varied in width at the load end of the slot to produce a second impedance matching network at the load end effective to reduce the slot reactance to the order of zero over the broad frequency band. As described above with respect to FIGS. 13 and 14, "h" is the thickness of the dielectric substrate 600 and "$h_u$" is the distance between the dielectric substrate and the metal shield 206. The two feed lines 602A, 602B may be connected to separate connectors, or to a common connector via a power divider. In all other respects, the slot radiator illustrated in FIG. 18 is constructed and operates substantially as described above with respect to FIGS. 13 and 14.

Figure 19:
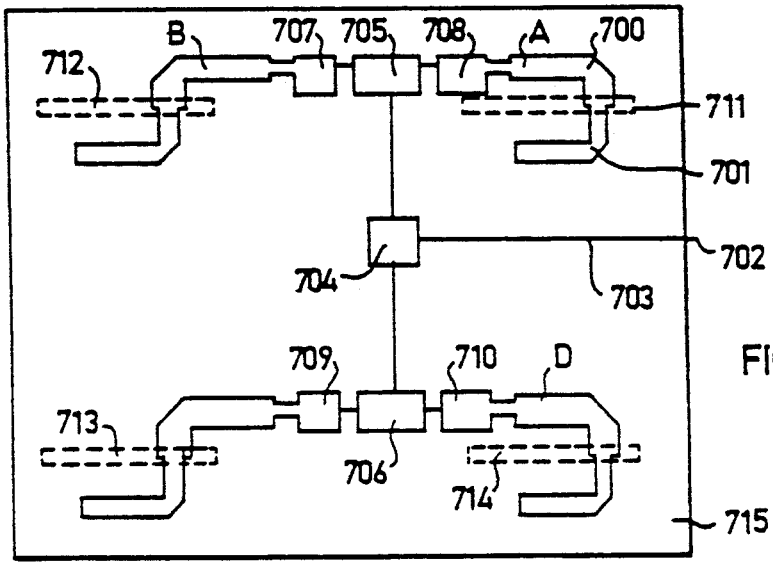
FIG. 19 is a bottom view of an antenna array including four microwave slot radiators constructed in accordance with the present invention.

FIG. 19 illustrates an example of an antenna array, using broadband microstrip slot radiators as described above. In this particular embodiment, four identical radiators, A, B, C, D, are fed using planar corporate feed. Each radiator in FIG. 19 is substantially the same as in FIGS. 13–15 except that the matching transformer 700 and open stub 701 are bent to achieve a more compact layout. The signal from the generator (not shown) is fed via connector point 702 by a 50-ohm microstrip 703 into a 2-way power divider 704. Additional power division is performed by two other power dividers 705 and 706. Each of the four signals obtained is fed through devices 707, 708, 709 and 710 to the individual slot radiators, B, A, C, D, respectively. Devices 707–710 may be power division circuitry, phase control circuitry and/or amplitude control circuitry, for feeding the radiators from the feed line. All microstrip connecting lines, generator sides of the broadband dual matching network, load sides of the broadband dual matching network, and radiating slots 711, 712, 713 and 714, are typically formed by photochemically etching copper clad surfaces and of dielectric substrate 715.

Although several embodiments of the invention have been described above, those skilled in the art will recognize that many variations and modifications may be made in these embodiments while still retaining many of the novel features and advantages of the invention. For example, the slot may have configurations other than rectangular, e.g., elliptical. In addition, the elements in an array of these antennas may be excited by different forms, such as space feed or lens. Also, while the invention is described above with respect to radiating antennas, the same principles apply with respect to receiving antennas. Accordingly, all such variations and modifications are intended to be included within the scope of the appended claims.

What is claimed is:

1. A broadband microwave antenna exhibiting high radiation efficiency over a broad frequency band in which the VSWR is less than 2.5:1 over at least 15% of the frequency band, comprising:

a dielectric substrate having two sides;

an electrically conductive layer serving as a ground plane on at least one side of the dielectric substrate;

a feed line in the form of a feed strip of electrically conductive material at the other side of the dielectric substrate;

said ground plane being formed with at least one radiating slot having a feed end at one side of the slot, and a load end at the opposite side of the slot, said feed end being electromagnetically coupled to said feed strip for feeding thereto the energy to be radiated or received;

said feed strip being of uniform width for substantially its complete length, but including a change in width at the feed end of the slot to produce a first impedance matching network at the feed end of the slot effective to bring the slot impedance to the level of the feed line over said broad frequency band;

said feed strip including another change in width at the load end of the slot to produce a second impedance matching network which reduces the slot reactance to match the reactive impedance of the load to the reactive part of the slot impedance over said broad frequency band.

2. The antenna according to claim 1, wherein said change in width of the feed strip at the feed end of the slot defines a non-quarter-wavelength transformer.

3. The antenna according to claim 1, wherein said change in width of the feed strip at the load end of the slot is of a length other than a quarter-wavelength.

4. The antenna according to claim 1, wherein said second impedance matching network includes a lumped reactive load.

5. The antenna according to claim 1, wherein said second impedance matching network includes an open-circuited stub of a length equal to an odd number of quarter wavelengths.

6. The antenna according to claim 1, wherein said second impedance matching network includes a short-circuited stub of a length equal to an even number of quarter wavelengths.

7. The antenna according to claim 1, wherein said second impedance matching network includes a lumped inductor and capacitor connected between the feed line and the ground plane.

8. The antenna according to claim 1, wherein said radiating slot is inclined at an angle to the feed line, the feed line and the two impedance matching networks traversing the slot at the center of the slot.

9. The antenna according to claim 1, wherein said radiating slot is inclined at an angle to the feed line, the feed line and the two impedance matching networks traversing the slot off-center of the slot.

10. The antenna according to claim 1, wherein said ground plane is formed with an additional radiating slot fed by the feed line and the two impedance matching networks.

11. The antenna according to claim 1, wherein a second feed line is electromagnetically coupled to said radiating slot, said first impedance matching network coupling the feed end of the slot to at least one of said feed lines.

12. The antenna according to claim 1, wherein the central frequency of the broad frequency band is substantially that of the slot resonance frequency.

13. The antenna according to claim 1, wherein the feed line side of the dielectric substrate is shielded by a metallic cover.

14. The antenna according to claim 1, further including an electrically conductive layer serving as a second ground plane on the opposite side of the dielectric substrate.

15. An antenna according to claim 1, further including a plurality of microwave antennas, and power division circuitry feeding the antennas from the feed line.

16. The antenna according to claim 1, further including a plurality of microwave antennas, and further including phase control circuitry for feeding the antennas from the feed line.

17. An antenna according to claim 1, further including a plurality of microwave antennas, and further including amplitude control circuitry for feeding the antennas from the feed line.

* * * * *